US007937877B2

(12) United States Patent
Barrett

(10) Patent No.: US 7,937,877 B2
(45) Date of Patent: May 10, 2011

(54) LIGHT WEIGHT FIREARM AND METHOD OF MANUFACTURING

(76) Inventor: Christopher Gene Barrett, Murfreesboro, TN (US)

( * ) Notice: Subject to any disclaimer, the term of this patent is extended or adjusted under 35 U.S.C. 154(b) by 96 days.

(21) Appl. No.: 11/714,946

(22) Filed: Mar. 7, 2007

(65) Prior Publication Data

US 2008/0216375 A1 Sep. 11, 2008

(51) Int. Cl.
*F41C 27/00* (2006.01)

(52) U.S. Cl. ..... 42/75.1; 89/125

(58) Field of Classification Search ..... 42/75.01, 42/75.02, 75.1, 71.01, 16, 72, 73; 89/16, 89/125, 191.01, 199
See application file for complete search history.

(56) References Cited

U.S. PATENT DOCUMENTS

| | | | | | |
|---|---|---|---|---|---|
| 2,088,268 | A * | 7/1937 | Lauf | 89/152 |
| 2,141,537 | A * | 12/1938 | Laloux | 42/75.01 |
| 3,198,076 | A * | 8/1965 | Stoner | 89/128 |
| 3,342,171 | A * | 9/1967 | Ryan et al. | 124/55 |
| 3,386,336 | A * | 6/1968 | Roy | 89/128 |
| 3,688,641 | A * | 9/1972 | Curtis et al. | 89/189 |
| 3,731,588 | A * | 5/1973 | Curtis et al. | 89/1.4 |
| 3,791,256 | A * | 2/1974 | Curtis et al. | 89/185 |
| 3,830,003 | A * | 8/1974 | Clerke | 42/75.03 |
| 3,999,461 | A * | 12/1976 | Johnson et al. | 89/191.01 |
| 4,066,000 | A * | 1/1978 | Rostocil | 89/198 |
| 4,463,654 | A * | 8/1984 | Barnes et al. | 89/128 |
| 4,553,469 | A * | 11/1985 | Atchisson | 89/191.02 |
| 4,596,084 | A * | 6/1986 | Martial | 42/75.03 |
| 4,601,123 | A * | 7/1986 | Swearengen et al. | 42/72 |
| 4,654,993 | A * | 4/1987 | Atchisson | 42/71.01 |
| 4,663,876 | A * | 5/1987 | Reaume | 42/71.01 |
| 4,693,170 | A * | 9/1987 | Atchisson | 89/149 |
| 4,872,391 | A * | 10/1989 | Stoner | 89/155 |
| 4,893,547 | A * | 1/1990 | Atchisson | 89/187.01 |
| 5,195,226 | A * | 3/1993 | Bornancini | 42/75.1 |
| 5,256,100 | A * | 10/1993 | Wang | 446/473 |
| 5,440,099 | A * | 8/1995 | Smith | 219/137 R |
| 2003/0181128 | A1 * | 9/2003 | Blake | 446/475 |
| 2003/0196366 | A1 * | 10/2003 | Beretta | 42/71.01 |
| 2007/0033850 | A1 * | 2/2007 | Murello et al. | 42/71.01 |
| 2008/0229642 | A1 * | 9/2008 | Hu | 42/54 |

OTHER PUBLICATIONS

"Chapter 3: M240B Machine Gun", Apr. 27, 2005, Globalsecurity.org.*

* cited by examiner

*Primary Examiner* — Michael Carone
*Assistant Examiner* — Jonathan C Weber
(74) *Attorney, Agent, or Firm* — Bennet K. Langlotz; Langlotz Patent & Trademark Works, Inc.

(57) ABSTRACT

A firearm has a body formed of a unitary first shell and a unitary second shell. Each shell defines an open cavity and has a peripheral rim. The rims of the shells are connected together so that the cavities define a receiver chamber. A bolt reciprocates within the receiver chamber, and a barrel connected to the shells has a chamber positioned for operable engagement by the bolt. The shells may together define a gas tube, and may define a barrel receiving element, each shell having a barrel engagement element. Each shell may have a side panel with flat portions having a limited thickness, and elongated ribs of a greater thickness. The ribs may extend about the periphery of planar side panels, and may extend between the periphery and selected stress elements on the body including a buttstock mounting facility. A bolt handle slot may have opposed rows of spaced apart bolt handle guides in an alternating arrangement.

46 Claims, 6 Drawing Sheets

LIGHT WEIGHT FIREARM AND METHOD OF MANUFACTURING

FIELD OF THE INVENTION

This invention relates to firearms, and more particularly to belt-fed machine guns.

BACKGROUND AND SUMMARY OF THE INVENTION

Belt-fed machine guns are often referred to as "crew-served," because they are too heavy to be practically carried and operated by a single soldier. Such arms have important uses in the battlefield that justify their weight and the commitment of manpower to field them. However, even when mounted on a vehicle, aircraft, or naval craft, the weight of a machine gun is often a disadvantage that it is desirable to minimize. Efforts to reduce weight by substituting unconventional materials (e.g. titanium, aluminum, polymer) for conventional proven steel firearms have disadvantages (e.g. cost, galling, durability.)

Existing belt fed machine guns (e.g. M2, M1919, M240) are typically formed with a receiver in the form of a steel box in which a bolt reciprocates, with a barrel extending from the receiver, and a belt passage extending transversely though the receiver. The box is formed of side plates having guides (slots or ribs) that guide the bolt movement, a bottom plate, and a top plate that opens to facilitate loading. A cylindrical trunnion or barrel-receiving collar is attached at a forward end of the box, and a rear plate is attached at the rear end of the box, with a buttstock or handle attached. The internal bolt guides, external guides for an external charging handle, and any other reinforcing portions are formed as extra sheets of metal, which are overlaid on the main sheets, and riveted in place.

Conventional box-like receivers are assembled from separate parts, with overlapping plate edges that are riveted together for adequate strength. Side plates are flat sheets, and a u-shaped bottom plate has upturned edges that overlap the bottom edges of the side plate for attachments by rivets that pass through both pieces. Where added strength or wear resistance is needed (at the edges that define a charging-handle slot, for instance), strength elements such as metal strips of L-bars are riveted in place. Such an assembly technique creates added weight, due to the necessary overlapping of the riveted parts. Where strength elements are added, or any overlap is needed for riveting, the size of the part or overlap may need to be increased to provide an adequate radius around each rivet, further increasing the part size and firearm weight.

Moreover, the conventional fabrication from plates or sheet metal requires an essentially constant thickness for several reasons. These include manufacturing cost constraints, the need for an enclosed receiver to prevent incursion of dirt, and concerns regarding warpage when sheets are machined.

Seams, rivet holes, and other points of overlap may create opportunities for corrosion. Even with corrosion-resistant coatings, where sheets overlap for attachment, a small gap exists in which moisture can wick, and in which rust generally develops over time, reducing the useful life of the firearm.

Fabrication of receivers from multiple assembled components has further disadvantages. Numerous parts are required to be inventoried for manufacturing and repair. Dimensional errors may accumulate due to imprecision of assembling the components. With the effects of heat-treating and coatings, dimensions may shift due to warpage. The intense forces during operation may further loosen these connections, making a firearm unreliable or dangerous. Larger tolerances that are required to compensate for these issues may reduce potential accuracy of the firearm.

The present invention overcomes the limitations of the prior art by providing a firearm having a body formed of a unitary first shell and a unitary second shell. Each shell defines an open cavity and has a peripheral rim. The rims of the shells are connected together so that the cavities define a receiver chamber. A bolt reciprocates within the receiver chamber, and a barrel connected to the shells has a chamber positioned for operable engagement by the bolt.

The shells may together define a gas tube, and may define a barrel receiving element, each shell having a barrel engagement element. Each shell may have a side panel with flat portions having a limited thickness, and elongated ribs of a greater thickness. The ribs may extend about the periphery of planar side panels, and may extend between the periphery and selected stress elements on the body. A bolt handle slot may have opposed rows of spaced apart bolt handle guides in an alternating arrangement.

DETAILED DESCRIPTION OF A PREFERRED EMBODIMENT

Figure 1:
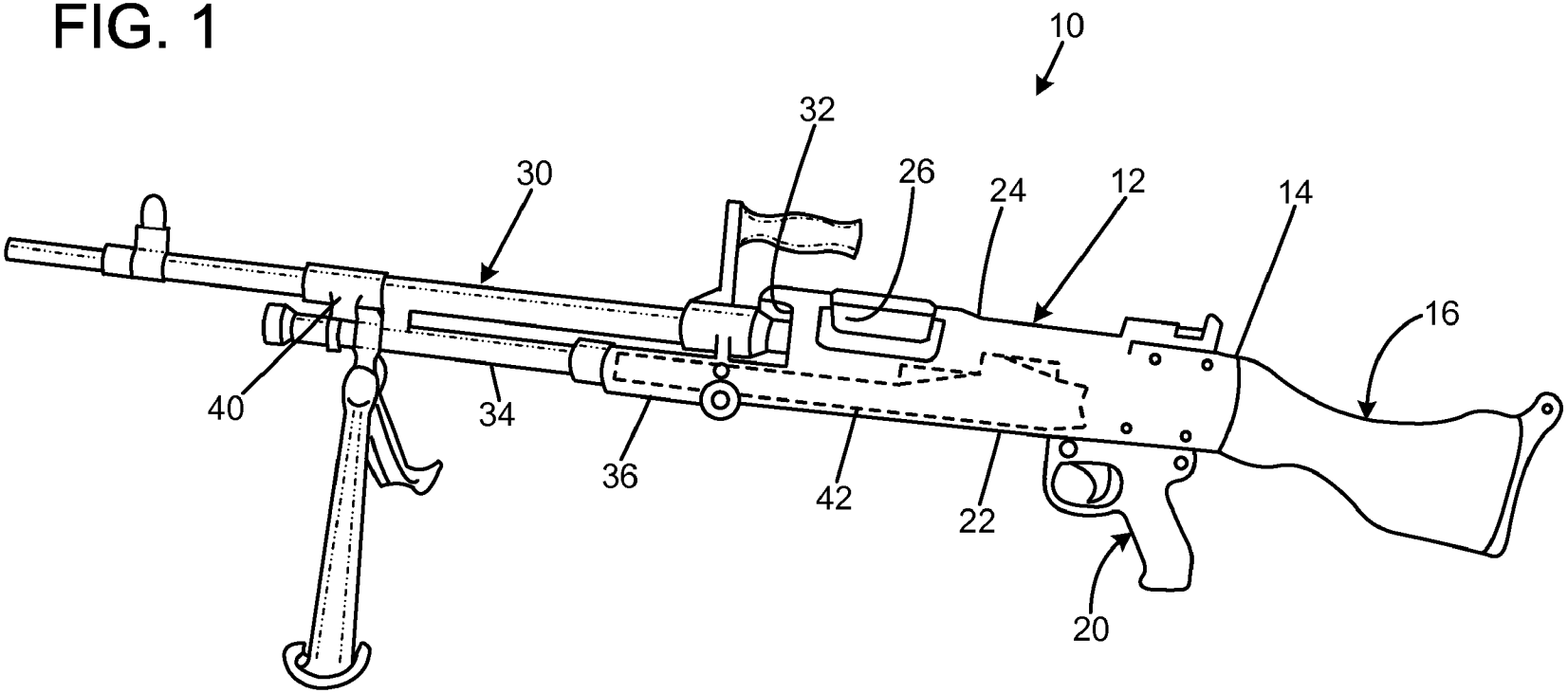
FIG. 1 is a side view of a rifle according to a preferred embodiment of the invention.

FIG. 1 shows a belt fed machine gun 10 having a box shaped receiver 12 with a rear end 14 to which a butt stock 16 is removably attached. A trigger assembly 20 is removably attached to a rear end of a lower surface 22 of the receiver. A hinged top plate 24 is pivotally connected to provide an upper surface of the receiver . A belt passage 26 passes transversely through the receiver at a forward position below the top plate. A removable barrel 30 extends forward from an upper forward portion 32 of the receiver. A gas tube 34 extends forward from an lower extension 36 of the receiver, which extends forward from a lower main box portion of the receiver. The gas tube 34 has a gas connection to the interior of the barrel at a forward end via gas block 40. Thus, gas pressure in the barrel from firing a shot is transmitted back through the gas tube to provide force on a bolt assembly 42 (shown in dashed lines) to cycle the action of the machine gun.

The illustrated machine gun is the functional and operational equivalent of the well-known M240 or Mag 58 machine gun, except that the receiver has some distinct structural differences to provide significant advantages over conventional models of this machine gun.

Figure 2:
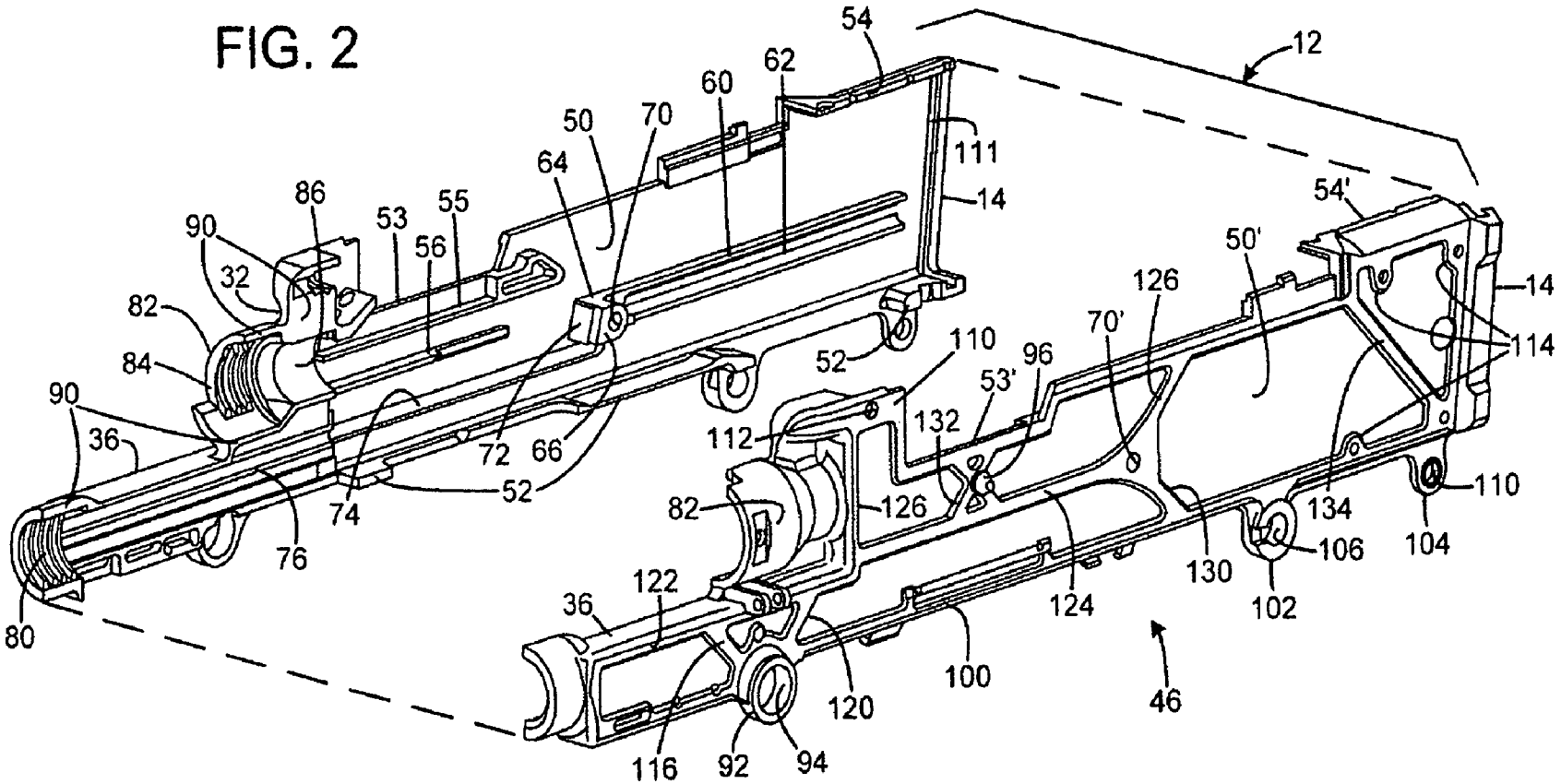
FIG. 2 is an exploded view of the receiver shell elements of the embodiment of FIG. 1.

As shown in FIG. 2, the receiver 12 is formed of two pieces: a right half shell 44 and a left half shell 46. The shells are primarily symmetrical in certain respects, in that they are separated by and joined at a vertical medial plane that coincides with the major axis of the machine gun and of the barrel. However, the shells have certain differences that are necessary for function, and which will be discussed below.

The right shell 44 has a major sidewall 50 that is a large planar surface. A lower wall 52 formed in several segments extends horizontally and medially from a lower edge of the vertical sidewall 50. An upper wall 54 extends perpendicularly and medially from a rear portion of an upper edge of the sidewall 50. A forward portion of the sidewall defines a feed cut out 53 at the upper edge, and the sidewall has several features on the interior surface that are largely common to the prior art device, but which are integrally formed with the shell. A first horizontal guide 55 is positioned immediately below cut out 53, a second horizontal guide 56 is positioned below the first guide, and a third guide 60 defining a channel 62 is positioned rearward of the second guide. A forward end portion 64 of the third guide protrudes medially to an end surface 66 that occupies the medial plane of the firearm (as do the peripheral edges of the upper and lower walls 54, 52. The end portion 64 defines a transverse bore 70, and has a forward face 72 that faces forward and is angled slightly upward. The forward face serves as a bolt stop to limit the rearward recoil motion of the bolt 42. The sidewall 50 further defines a horizontal elongated bolt handle slot 74 that extends from a forward end of the sidewall to an intermediate location below the bore 70.

The forward end of the shell 44 includes the right half of the protruding lower extension 36.

The extension is essentially an elongated semi cylindrical body, defining a medially-facing channel 76 in which an elongated forward portion of the bolt reciprocates, with a close fit allowing the bolt to function as a piston in a gas cylinder formed by the channel. The forward end of the extension 36 is a semi cylindrical element defining a large threaded semi cylindrical bore 80 for receiving the gas tube.

Above the extension 36, on the medial plane of the receiver, is the right half of a barrel receiving element 82, which is a semi cylindrical extension having a bore defining interrupted buttress threads 84. The threads occupy slightly less than 90° of the circumference of the element, to so that a conventional M240 barrel may be used.

The left shell 46, like the right shell 44, has a major sidewall 50' that is a large planar surface. Except for the bolt handle slot 74, the left shell has essentially all the same features and elements as the right shell, with only limited exceptions, such as may be discussed elsewhere. A lower wall 52' (not shown) formed in several segments extends perpendicularly and medially from a lower edge of the sidewall 50. An upper wall 54' extends perpendicularly and medially from a rear portion of an upper edge of the sidewall 50. A forward portion of the sidewall defines a feed cut out 53', and the sidewall has several features on the interior surface that are largely common to the prior art device, but which are integrally formed with the shell. A first horizontal guide 55' (not shown) is positioned immediately below cut out 53', a second horizontal guide 56' (shown in FIG. 7) is positioned below the first guide, and a third guide 60' (shown in FIG. 7) defining a channel 62' is positioned rearward of the second guide. A forward end portion 64' of the third guide protrudes medially to an end surface 66' that occupies the medial plane of the firearm and abuts the end surface 66 of the right shell. The end portion 64 defines a transverse bore 70' that registers with bore 70, and has a forward face 72' that faces forward and is angled slightly upward, in the same plane as face 72 of the right shell. Together, forward faces serve as a bolt stop to limit the rearward recoil motion of the bolt 42.

The forward end of the shell 46 includes the left half of the protruding lower extension 36. The extension is essentially in the elongated semi cylindrical body, defining a channel that together with channel 76 provides an enclosed passage in which an elongated forward portion of the bolt reciprocates. The forward end of the extension 36 is a semi cylindrical element mirroring that of the right shell, and defining a large threaded semi cylindrical bore 80. When the shells are mated, a complete threaded bore is formed for threadably connecting the gas tube 34.

Above the extension 36, on the medial plane of the receiver, is the left half of a barrel receiving element 82, which is a semi cylindrical extension having a bore defining interrupted buttress threads 84. Together with the opposite element, a complete cylindrical body or barrel collar (trunnion) is formed, with internal threads for receiving the barrel, and defining a rearward passage 86 extending into the chamber defined by the receiver shells, so that the bolt and barrel may interact for firearm operation. Both the extension 36 and barrel receiving element 82 of each shell have medial surfaces 90 that occupy the medial plane of the firearm, such that they abut when assembled and welded together.

The major exterior features visible on the left shell 46 include a cylindrical sleeve 92' defining a transverse bore 94' to serve as a mounting point for mounting the firearm on a tripod or pintle. Thus, this element (and the corresponding element on the other shell) absorbs the rearward forces of recoil, as well as a major portion of the weight of the firearm.

Below the feed cut out 53', a button 96 protrudes perpendicularly from the sidewall 50'. The button serves to support an ammunition feed device (not shown), such as a box containing belted ammunition. A slot 100 at the lower edge of the sidewall, below the button 96, also serves to engage such a feed device. Thus, the button is subject to bending and shearing as forces may be applied to the feed device during transportation or operation of the firearm.

At the lower edge of the shell, near the rear, a pair of lobes 102, 104 depend downwardly, and each define a respective transverse bore 106, 110. These serve as mounting locations for the trigger assembly 20, and have symmetrical counterparts on the opposite shell. At the rearmost end of both shells, a medially-open dovetail groove 111 extends about the inner periphery to receive a mating flange at the forward end of the buttstock 16.

The sidewall 50' of the left shell (as with the right shell) is generally in the form of a thin panel having large areas having a limited thickness of 0.050 inch. With the receiver formed of steel, this thickness is intended primarily to serve as a panel to durably enclose the receiver chamber, and to provide only limited structural support for the forces and stresses that the firearm undergoes during operation. In alternative embodiments such as for larger or smaller rifles of similar operational design (such as those presently formed by riveting plates to form receiver boxes) this basic wall thickness may range from 0.050 to 0.200 inch.

The periphery of the sidewall is formed as a rib, with a significantly greater thickness of 0.100 inch, which is double the panel thickness. This provides for rigid and structurally sound transitions to the upper and lower wall portions, and to effectively transmit and distribute mechanical stresses throughout the shell. The peripheral rib includes widened portions (110, such as to reinforce a bore 112 for the pivot pin of the top plate 24), and includes extended lobes 114, which provide reinforcement for other pins or attachments.

In addition, thickened ribs extend variously across the expanse of the thin wall portions extending between peripheral ribs, between specific points of stress in non-peripheral locations, and between stress points and the periphery.

A first rib 116 extends upward and forward from sleeve 92, and a similar second rib 120 extends upward and rearward, both in an opposite 45° angle from horizontal. These serve to distribute some of the stresses on the sleeve 92 to the upper rib 122 at the top edge of the extension 36.

An elongated horizontal rib 124 extends forward from bore 70' to the peripheral rib 126 at the forward surface associated with the barrel receptacle 82. Additional ribs 126, 130 extend diagonally upward and downward, respectively, from the bore 70' to the upper and lower peripheral ribs. These three ribs serve to distribute forces from the impact of the bolt on surface 72 throughout the shell structure.

The ammunition device support button 96 is reinforced by an "X"-shaped rib pattern 132 that distributes stresses on the button to rib 124 and to the peripheral rib associated with the feed cut out 52'.

A rear diagonal rib 134 provides a strengthening span between a lower rear corner of the side panel, and the intersection associated with the peripheral ribs associated with the lower rear corner of the top plate 24. This rib 134 serves to reinforce the mounting area associated with the buttstock 16 and the associated groove 111. This reinforcement is important because the buttstock (or spade grips that may be alternately substituted) receive the rearward impact of the bolt during operation, and transmit this impact force to the receiver. The stock contains a hydraulic buffer that stops the high speed recoiling bolt assembly.

Figure 3:
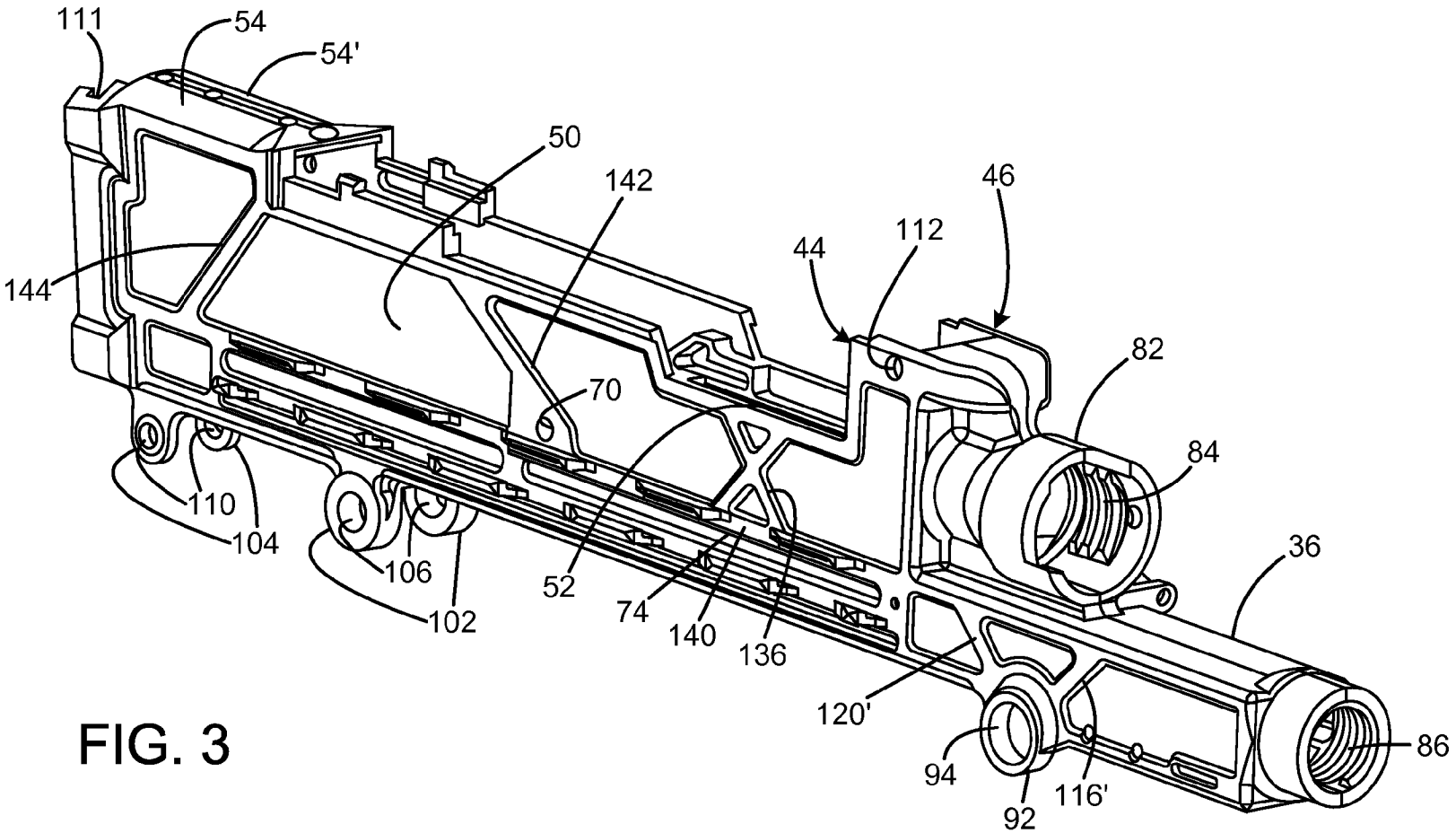
FIG. 3 is a perspective view of the receiver of the embodiment of FIG. 1.

FIG. 3 shows the shells 44, 46 as assembled, with the exterior face of the right shell's sidewall 50 being visible. The primary difference between the right shell and left shell's exterior is the presence of the bolt handle slot 74, and associated bolt handle retention elements that will be discussed below. Reinforcing ribs 116' and 120' correspond to the ribs 116 and 120 on the other side. An X-shaped reinforcing rib element 136 extends from the feed cut out 52 to a horizontal rib 140 defining the upper edge of the bolt handle slot 74.

A diagonal rib 142 extends upward and rearward from bore 70 in the manner of rib 126 of the opposite side. Rib 140 provides reinforcement below the bore. A diagonal rib 144 functionally corresponds to rib 134 on the opposite side.

Figure 4:
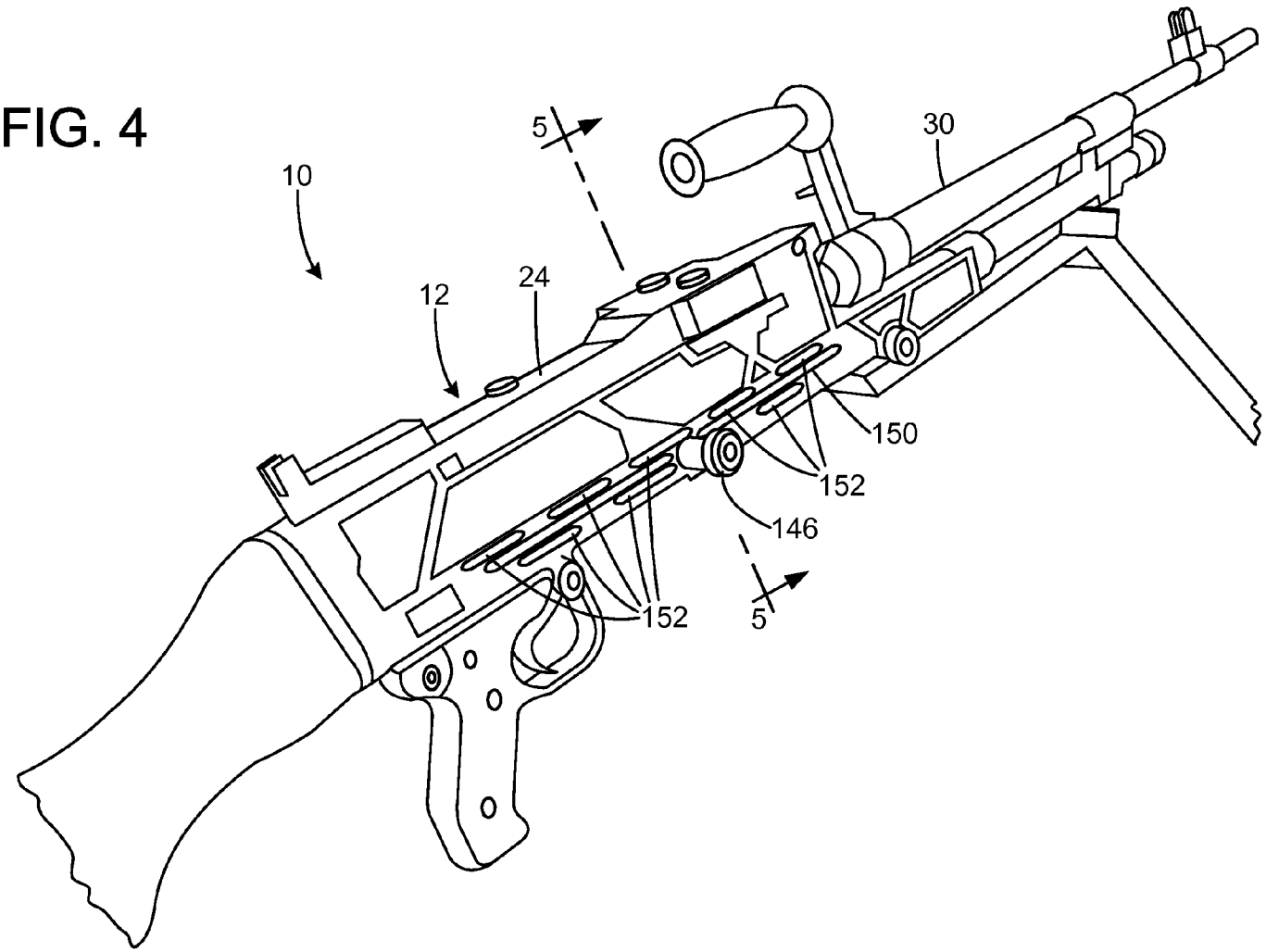
FIG. 4 is a side view of a rifle according to a preferred embodiment of the invention.

FIG. 4 shows a bolt handle 146 protruding from the rear end of an elongated bolt handle strip 150, which is connected at its forward end to the bolt inside the receiver. A connection between the forward end and the bolt passes through the bolt handle slot 74. To retain the bolt handle strip, and to constrain it only for reciprocation along the length of the rifle, several elongated bolt handle retention devices 152 are formed integrally with the right shell. The devices are positioned in two rows, each row on opposite sides of a path defined by the bolt handle slot 74. The devices are spaced apart evenly in each row, with the spacing between the devices being about the same as the length of each device.

Figure 5:
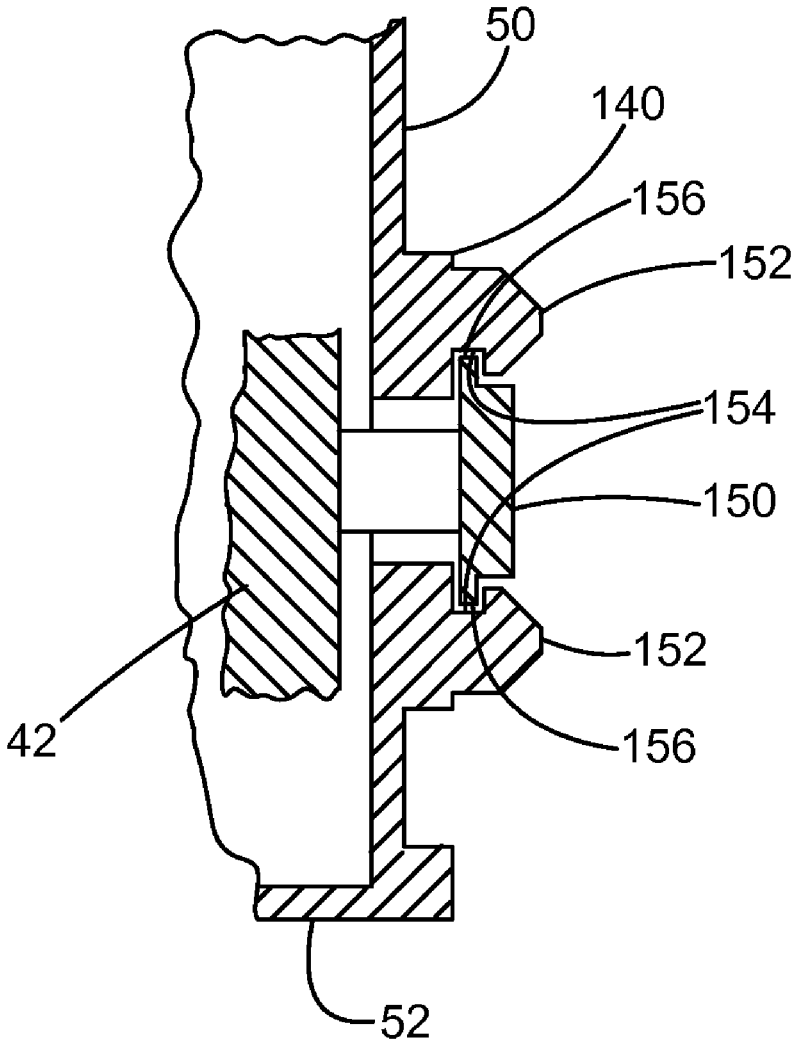
FIG. 5 is an enlarged sectional view taken along line 5-5 of FIG. 4.

FIG. 5 shows that each bolt handle retention device 152 has an overhang defining a channel 154 in which the upper and lower bolt handle strip edges 156 are captured.

Because the bolt handle strip has a length corresponding to at least two retention devices in each of the upper and lower rows, it is stably retained even with the gaps between the devices. The gaps provide the benefit of weight reduction, and further allow any debris that might become stuck in the channels to be easily cleared as it reaches a nearby gap. In the preferred embodiment, the bolt handle strip has a length of 11.0 inch, each retention device has a length of 1.080 inch, and there are five devices in the upper row, and six devices in the lower row, with the end devices in the lower row being of half-length.

Figure 6:
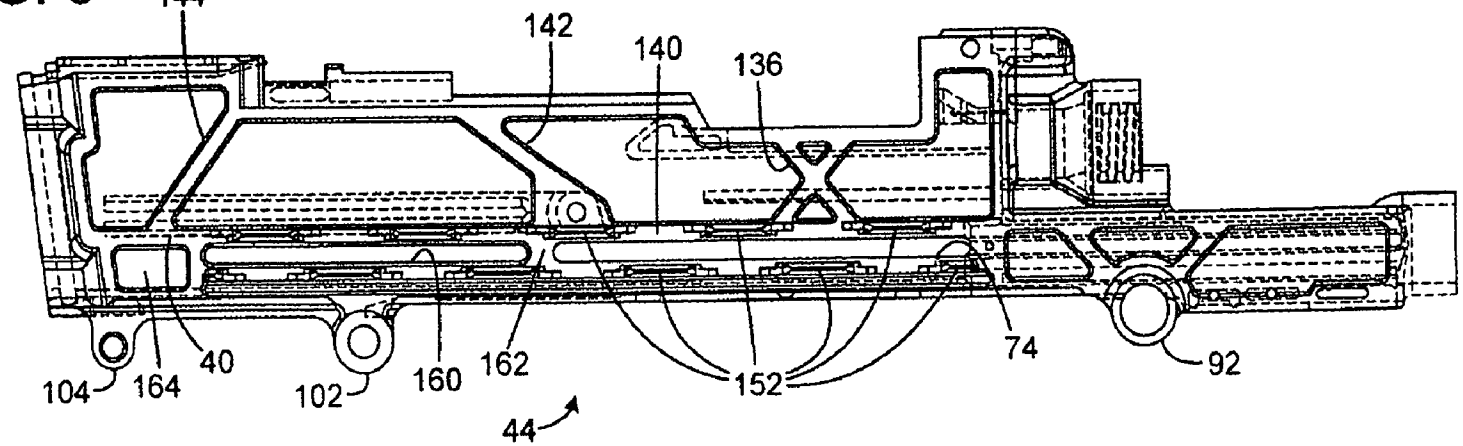
FIGS. 6 and 7 are side views of the respective receiver shells.
Figure 7:
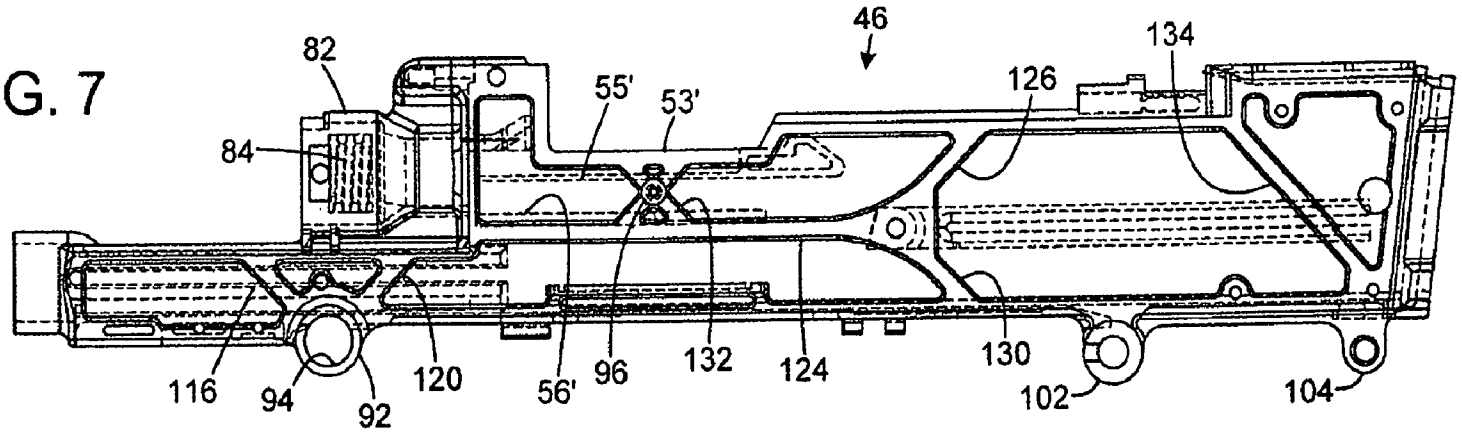

FIGS. 6 and 7 show the receiver shells in side views, with the interior structures illustrated in dashed lines, showing how the interior structures correspond to the exterior rib structures. A thin portion 160 between ribs and between the rows of retention devices extends rearward in line with the bolt handle slot 74, separated from the slot by a thickened rib portion 162. Rib 140 extends to the rear of the side panel, and a rectangular thin portion 164 is bounded at its upper portion by rib 140.

In the preferred embodiment, each shell is a unitary element formed as a single piece. In the preferred embodiment, each is machined from a single block of metal, preferably steel. This ensures that there are no cracks or seams in which corrosion generating fluid can accumulate. It also provides that all elements are precisely position with respect to each other, because of the precise nature of automated machining. In alternative embodiments, the shells may be manufactured by other means to generate unitary elements, such as injection molding in which case the shells may be injected or formed as one (whether advanced polymers, metals, or a combination) or other techniques.

The shells are welded together to join them at the medial plane by a process that ensures that gaps, cracks, and crevices are avoided, to reduce the risk of corrosion. After the two shells are welded the other elements of the firearm are assembled, including the bolt, gas tube, barrel, etc.

While the above is discussed in terms of preferred and alternative embodiments, the invention is not intended to be so limited. For instance, instead of merely two wall thicknesses (the thinner walls and the thicker ribs) a greater number of thicknesses may be used depending on the forces required to be withstood and transmitted. In addition, these principles need not be limited to flat panels, but may be used on curved and contoured surfaces. And the ribs need not be of constant thickness to provide a stepped surface, but may be sloped or curved, in the manner of certain organic structures found in nature, such as the ribs and veins of leaves.

The invention claimed is:

1. A method of manufacturing a firearm comprising the steps of:

forming a right receiver shell portion;

forming a left receiver shell portion;

connecting the right receiver shell portion to the left receiver shell portion to form a receiver defining a receiver chamber;

installing a reciprocating bolt in the receiver chamber; and connecting a barrel to the receiver, wherein the steps of forming the right receiver shell portion and forming the left receiver shell portion further comprise forming wall portions having flat areas having a first limited thickness, and forming a plurality of elongated rib portions having a second thickness greater than the first thickness on at least one of the shell portions, wherein the shell portion includes stress-concentration elements that are subject to the forces of recoil during firearm operation, and wherein a majority of the reinforcing ribs extend from the stress-concentration elements to anyone of another reinforcing rib or another stress-concentration element, such that weight is minimized while mechanical stresses arc effectively transmitted and distributed.

2. The method of claim 1, wherein the steps of forming the right receiver shell portion and forming the left receiver shell portion further comprise defining a bolt channel for bolt reciprocation.

3. The method of claim 1, wherein the steps of forming the right receiver shell portion and forming the left receiver shell portion further comprise defining barrel engagement thread portions on each of the right receiver shell portion and the left receiver shell portion.

4. The method of claim 1, wherein the steps of forming the right receiver shell portion and forming the left receiver shell portion further comprise forming a semi-cylindrical barrel receiving element portion on each of the right receiver shell portion and the left receiver shell portion.

5. The method of claim 1, wherein the steps of forming the right receiver shell portion and forming the left receiver shell portion include machining each of the right receiver shell portion and the left receiver shell portion from a unitary element.

6. The method of claim 1, wherein the step of connecting the right receiver shell portion to the left receiver shell portion to form a receiver defining a receiver chamber includes welding.

7. The method of claim 1, wherein the steps of forming the right receiver shell portion and forming the left receiver shell portion further comprise defining a semi-cylindrical gas tube receiving element portion on each of the right receiver shell portion and the left receiver shell portion.

8. The method of claim 1, wherein the steps of forming the right receiver shell portion and forming the left receiver shell portion further comprise defining gas tube engagement thread portions on each of the right receiver shell portion and the left receiver shell portion.

9. The method of claim 8, further comprising the step of connecting a gas tube to the receiver with the gas tube engaging the gas tube engagement thread portions on each of the right receiver shell portion and the left receiver shell portion and the gas tube having a gas connection to the barrel's interior.

10. The method of claim 1, wherein the ribs are formed on an exterior surface of the shell portion.

11. The method of claim 1, wherein the shell portion has a major side panel portion having a periphery, and wherein at least some of the ribs are peripheral ribs located at the periphery.

12. The method of claim 11, wherein the major side panel portion includes at least a spanning rib extending from a peripheral rib.

13. The method of claim 12, wherein the spanning rib extends between peripheral ribs.

14. The method of claim 12, wherein the spanning rib extends diagonally from a top edge rib to a bottom edge rib.

15. The method of claim 1, wherein at least one of the stress-concentration elements is a bolt stop.

16. The method of claim 1, wherein at least one of the stress-concentration elements is a bolt handle slot.

17. The method of claim 1, wherein at least one of the stress-concentration elements is a tripod connection element.

18. The method of claim 1, wherein at least one of the stress-concentration elements is a traverse and elevation element.

19. The method of claim 1, wherein at least one of the stress-concentration elements is an ammunition supply mounting element.

20. The method of claim 1, wherein at least one of the stress-concentration elements is a trigger housing connection element.

21. The method of claim 1, wherein at least one of the stress-concentration elements is a buttstock mounting facility.

22. The method of claim 1, wherein at least one of the stress-concentration elements is a shell corner.

23. The method of claim 1, wherein at least one of the stress-concentration elements is a shell periphery.

24. A receiver for a firearm, comprising:

a right receiver shell portion;

a left receiver shell portion;

connecting the right receiver shell portion to the left receiver shell portion to form a receiver defining a receiver chamber;

a reciprocating bolt within the receiver chamber; and a barrel connected to the receiver, wherein the right receiver shell portion and the left receiver shell portion further comprise wall portions having flat areas having a first thickness, and a plurality of elongated reinforcing rib portions having a second thickness greater than the first thickness on at least one of the shell portions, wherein the shell portion includes stress-concentration elements that are subject to the forces of recoil during firearm operation, and wherein a majority of the reinforcing ribs extend from the stress-concentration elements to anyone of another reinforcing rib or another stress-concentration element, such that weight is minimized while mechanical stresses are effectively transmitted and distributed.

25. The receiver of claim 24, wherein the right receiver shell portion and the left receiver shell portion define a bolt channel for bolt reciprocation.

26. The receiver of claim 24, wherein right receiver shell portion and the left receiver shell portion each define barrel engagement thread portions.

27. The receiver of claim 24, wherein the right receiver shell portion and the left receiver shell each comprise a semi-cylindrical barrel receiving element portion.

28. The receiver of claim 24, wherein the right receiver shell portion and the left receiver shell are each machined from a unitary element.

29. The receiver of claim 24, wherein the right receiver shell portion is connected to the left receiver shell portion to form a receiver defining a receiver chamber by welding.

30. The receiver of claim 24, wherein the right receiver shell portion and the left receiver shell portion each define a semi-cylindrical gas tube receiving element portion.

31. The receiver of claim 24, wherein the right receiver shell portion and the left receiver shell portion each define gas tube engagement thread portions.

32. The receiver of claim 31, further comprising a gas tube connected to the receiver with the gas tube engaging the gas tube engagement thread portions on each of the right receiver shell portion and the left receiver shell portion and the gas tube having a gas connection to the barrel's interior.

33. The receiver of claim 24, wherein, the ribs are formed on an exterior surface of the shell portion.

34. The receiver of claim 24, wherein the shell portion has a major side panel portion having a periphery, and wherein at least some of the ribs are peripheral ribs located at the periphery.

35. The receiver of claim 34, wherein the major side panel portion includes at least a spanning rib extending from a peripheral rib.

36. The receiver of claim 35, wherein the spanning rib extends between peripheral ribs.

37. The receiver of claim 35, wherein the spanning rib extends diagonally from a top edge rib to a bottom edge rib.

38. The receiver of claim 24, wherein at least one of the stress-concentration elements is a bolt stop.

39. The receiver of claim 24, wherein at least one of the stress-concentration elements is a bolt handle slot.

40. The receiver of claim 24, wherein at least one of the stress-concentration elements is a tripod connection element.

41. The receiver of claim 24, wherein at least one of the stress-concentration elements is a traverse and elevation element.

42. The receiver of claim 24, wherein at least one of the stress-concentration elements is an ammunition supply mounting element.

43. The receiver of claim 24, wherein at least one of the stress-concentration elements is a trigger housing connection element.

44. The receiver of claim 24, wherein at least one of the stress-concentration elements is a buttstock mounting facility.

45. The receiver of claim 24, wherein at least one of the stress-concentration elements is a shell corner.

46. The receiver of claim 24, wherein at least one of the stress-concentration elements is a shell periphery.

* * * * *